United States Patent [19]

Marks

[11] Patent Number: 4,758,192

[45] Date of Patent: Jul. 19, 1988

[54] WATER SKI BINDING AND METHOD OF ASSEMBLY

[76] Inventor: Ronald H. Marks, 7 Hafey Rd., Kenhurst, N.S.W., Australia

[21] Appl. No.: 30,882

[22] Filed: Mar. 26, 1987

[51] Int. Cl.[4] ..... A63C 15/06

[52] U.S. Cl. ..... 441/70

[58] Field of Search ..... 441/70, 74, 75, 68; 280/614, 623; 114/39.2; 403/315, 381

[56] References Cited

U.S. PATENT DOCUMENTS

| | | | |
|---|---|---|---|
| 2,369,930 | 2/1945 | Wagner, Sr. | 403/381 X |
| 3,604,032 | 9/1971 | Kiefer | 441/70 |
| 3,731,328 | 8/1973 | Russell | 441/70 |
| 3,750,204 | 8/1973 | Walter | 441/70 |
| 4,022,491 | 5/1977 | Powell | 280/618 |
| 4,279,048 | 7/1981 | Bundschuh et al. | 280/633 |
| 4,389,200 | 6/1983 | O'Brien | 441/70 |
| 4,408,779 | 10/1983 | Shekter | 280/607 |
| 4,499,674 | 2/1985 | Olivieri | 36/117 |
| 4,592,734 | 6/1986 | Metiver | 114/39.2 |

*Primary Examiner*—Sherman D. Basinger

*Attorney, Agent, or Firm*—Charles D. Gunter, Jr.

[57] ABSTRACT

A water ski binding is shown which has a base plate mounted on an upper surface of the water ski. The base plate has a top surface and a bottom surface. The top surface of the base plate is provided with a pair of tracks which are arranged in spaced-apart locations. A foot-receiving member is formed from a resilient material and has depending runners. The runners are received within and engage the tracks provided in the top surface of the base plate to thereby secure the foot-receiving member on the water ski.

13 Claims, 2 Drawing Sheets

FIG. 1
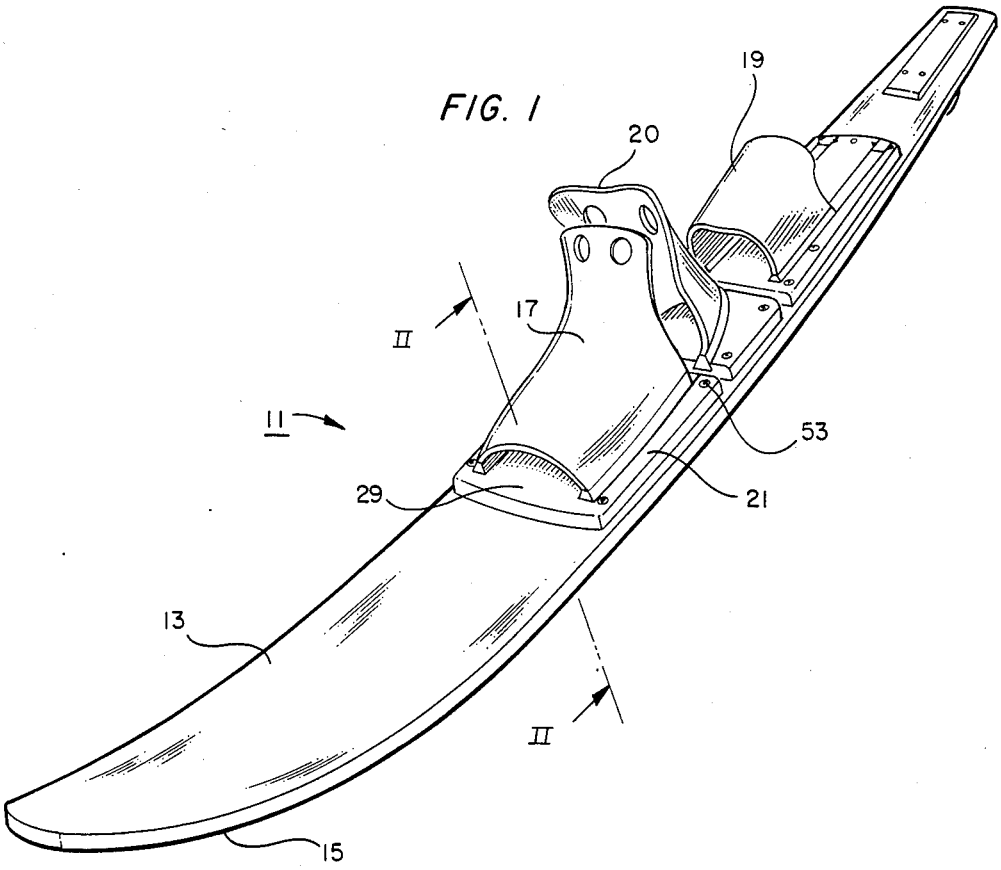
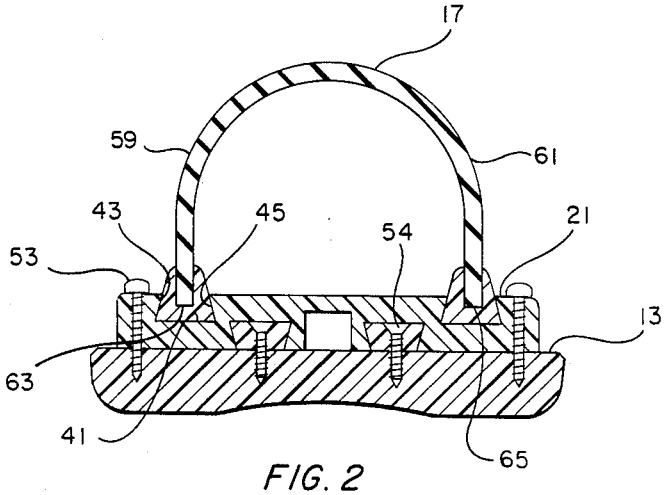
FIG. 2

WATER SKI BINDING AND METHOD OF ASSEMBLY

BACKGROUND OF THE INVENTION

1. Field of the Invention

The present invention relates to water ski bindings and an improved method for assembling a binding onto a ski.

2. Description of the Prior Art

At the present time, water skis are manufactured by assembling a foot-receiving binding on an upper surface of the water ski. Usually, the foot-receiving binding includes an elastomeric arch-shaped portion which maybe attached to a base plate which, in turn, is attached to the upper surface of the ski. U.S. Pat. No. 4,389,200, issued June 21, 1983, to O'Brien shows a typical prior art water ski binding. In the O'Brien binding, the elastomeric strips extend substantially vertically from the edges of the base plate where they are secured by a plurality of screws. In other of the prior art designs, the elastomeric binding strips were attached to the base plate by I-shaped side clamps and screws.

While the O'Brien method provides a secure ski binding, the screw installation is labor intensive and time consuming, adding to the cost of manufacture. Also, the prior art design which utilized mounting screws for the binding did not provide a convenient method for changing the size or style of the binding.

An object of the present invention is to provide a water ski binding which can be easily assembled on a water ski in a minimum amount of time and with a minimum number of assembly steps.

Another object of the invention is to provide a ski binding which can conveniently be removed and replaced, to provide an easy method for changing the size and/or style of the binding on the ski.

Additional objects, features and advantages will be apparent in the written description which follows.

SUMMARY OF THE INVENTION

The water ski binding of the invention includes a base plate which is adapted to be mounted on an upper surface of a water ski. The base plate has a top, generally planar surface and a bottom, generally planar surface. The top surface of the base plate is provided with a pair of tracks arranged in spaced-apart, parallel locations. The tracks define a cross-sectional profile in the top surface of the base plate. A foot-receiving member, formed from a resilient material, is provided with depending runners. The runners have a complementary cross-sectional profile which mates with that of the tracks when the runners are received within the tracks to secure foot-receiving member to the water ski.

In assembling the binding on the water ski, the base plate can first be mounted on the upper surface of the water ski. The runners of the foot-receiving member are then engaged on the base plate by sliding the runners into the tracks provided in the top surface of the base plate. Preferably, the foot-receiving member is then locked to the base plate by sliding a plug into at least one of the tracks behind the runner which is received within the track.

DESCRIPTION OF THE DRAWINGS

FIG. 1 is a prospective view of a water ski having the improved binding of the invention mounted thereon.

FIG. 2 is a cross-sectional view taken along lines II—II in FIG. 1.

DESCRIPTION OF THE PREFERRED EMBODIMENT

Figure 3:
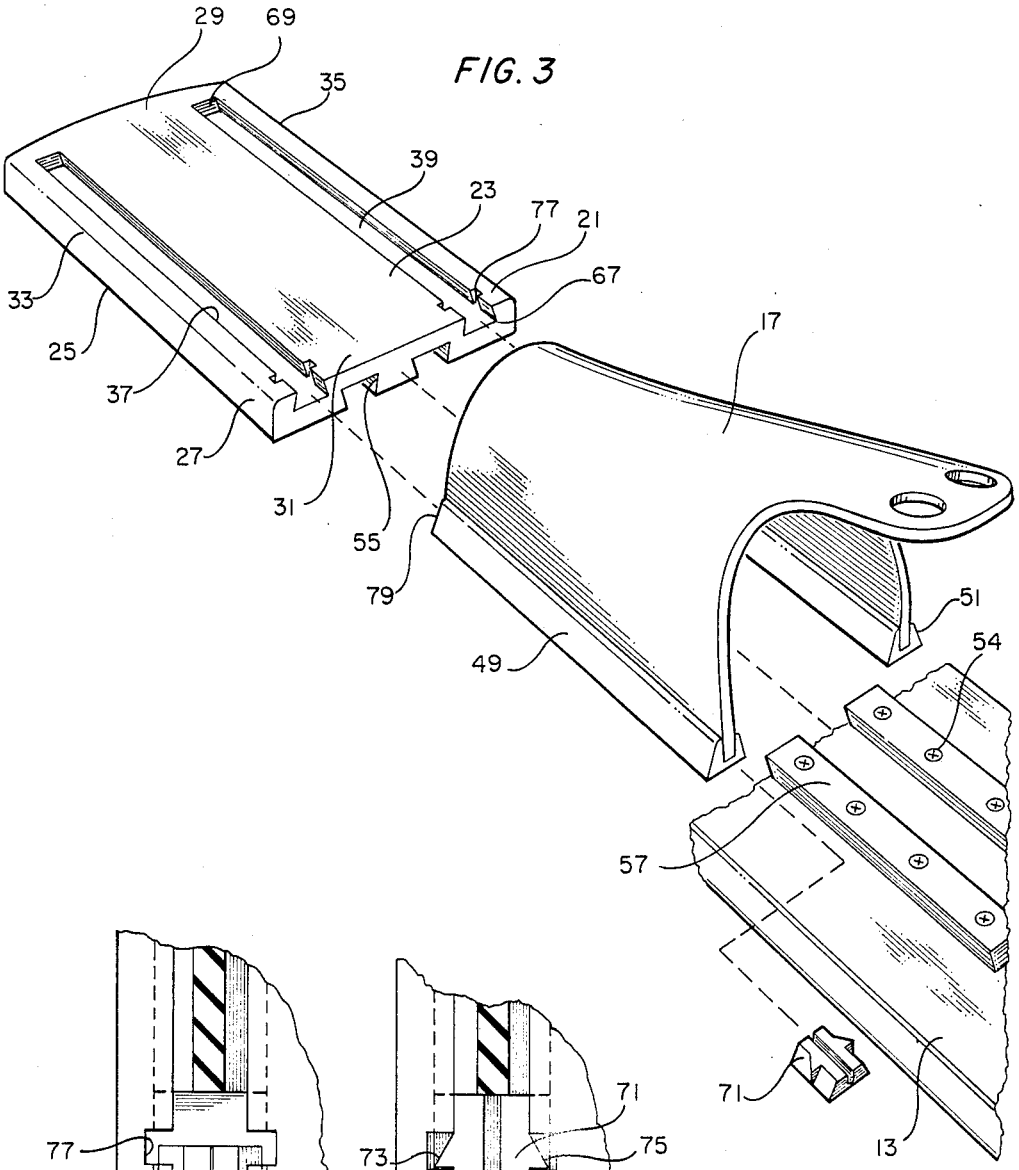
FIG. 3 is an assembly view of the improved water ski binding of the invention.

FIG. 1 shows a water ski, designated generally as 11 having the improved binding of the invention. The water ski 11 has an upper surface 13 and a lower surface 15. The invention will be described with respect to the arch-shaped foot-receiving member 17, although it will be understood that the invention could be applied to other portions of the binding, such as the rear, foot-receiving member 19, or the heel receiving member 20.

As shown in FIGS. 1 and 3, a base plate 21 is mounted on the upper surface 13 of the water ski. The base plate 21 has a top, or upper, generally planar surface 23 and a bottom, generally planar surface 25 separated by a thickness 27 to thereby define a toe region 29, a back 31 and opposing sides 33, 35 of the base plate. The top surface 23 of the base plate is provided with a pair of tracks 37, 39 arranged in space-apart locations which run generally parallel to the opposing sides 33,35.

As shown in FIG. 2, each of the tracks defines a cross-sectional profile in the top surface 23 of the base plate 21. The preferred profile shown in FIG. 2 is dovetailed in cross-section, each of the tracks having a bottom surface 41 and inwardly inclined sidewalls 43, 45.

The track profile is adapted to matingly engage with the arch-shaped, foot-receiving member 17. Preferably, the foot-receiving member 17 is formed from resilient material designed to comfortably enclose a portion of the foot of the user. The foot-receiving member 17 has depending runners 49, 51 which have a complimentary cross-sectional profile which mates with that of the tracks 37, 39 when the runners 49, 51 are received within the tracks, to secure foot-receiving member 17 to the water ski 11. As shown in FIG. 1, the base plate 21 can be secured to the upper surface 13 of the water ski by any convenient means, such as screws 53, or by a suitable adhesive. If desired, the base plate can be made adjustable by a ratchet or other locking mechanism attached thereto so as to allow movement back and forth. Grooves 55 can also be provided in the bottom surface 25 of the base plate for engaging mating ribs 57 on the upper surface 13 of the ski, the ribs being secured to the surface 13 by screws 54. It will be understood that the base plate 21 could as easily be installed on an intermediate mounting, such as an aluminum plate, which would then, in turn, be affixed to the water ski 11.

The arch-shaped, foot-receiving member 17 is preferably formed as an elastomeric, arch-shaped portion having opposing sides (59, 61 in FIG. 2) which terminate in side edges 63, 65. Each of the runners 49, 51 can be provided as an initially separate, rigid member which is attached to the side edges 63, 65. Thus, the runners 49, 51 shown in FIGS. 2 and 3 could be bonded to the member 17 by a suitable adhesive or affixed by means of transverse pins or teeth passing through the runners 49, 51 and through the arch-shaped member. The arch-shaped, foot-receiving member 17 can also be formed in one piece, as an integrally molded elastomeric member. Presently available "slush" molding or injection molding techniques allow the member to be formed whereby the runner portions 49, 51 are relatively rigid, higher durometer, and the arch-shaped portion is relatively flexible, lower durometer.

Figure 4A:
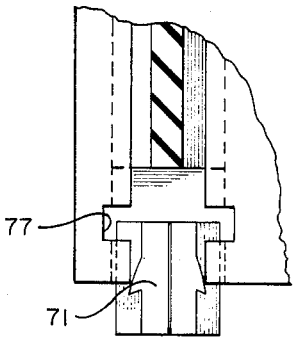
FIG. 4*a* is a top view of a portion of the base plate of FIG. 3 showing the beginning installation of the plug into the base plate track.
Figure 4B:
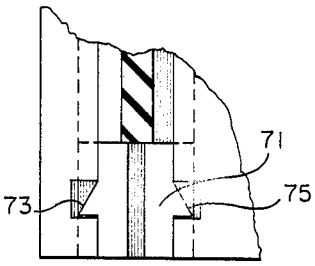
FIG. 4*b* is a view similar to FIG. 4*a* showing the completed installation of the plug.

As shown in FIG. 3, each of the tracks 37, 39 has an open end 67 and a closed end 69. As shown in FIGS. 4*a* and 4*b*, the foot-receiving member 17 is preferably locked within the tracks by means of a suitably shaped plug 71 which is installed within at least one of the tracks 37, 39 after the installation of the member 17. Preferably, a plug is installed within the open end of each track. In the embodiment illustrated in the drawings, the plug 71 is provided with ears 73, 75 which engage a recess 77 provided adjacent the open-end 67 of each track. However, this is not to limit the method of retention of the member 17 which could as easily be effected by securing a fastening device such as a screw in either a vertical or horizontal direction through the open end 67 of tracks 37 and/or 39.

In operation, the ski binding is assembled by first mounting the base plate 21 on the upper surface 13 of the water ski 11. The foot-receiving member 17 is then engaged on the base plate 21 by sliding the runners 49, 51 into the tracks 37, 39 provided in the top surface 23 of the base plate, until the forward extent 79 of the runners engages the closed end 69 of the tracks. The dove-tailed cross-sectional profile of the runners 49, 51 restrains the member 17 from vertical movement within the tracks 37, 39. A plug 71 is then inserted within the open end 67 of at least one of the tracks 37, 39 to retain longitudinal travel of the member 17 within the tracks.

An invention has provided with several advantages. The improved ski binding is simple in design and economical to manufacture. The binding is quickly installed by simply sliding runners into mating tracks provided in the base plate of the binding. This operation is quick and efficient, thereby saving assembly time and manufacturing expense. Because of the ease of installation, the size and style of the binding can be quickly changed by simply removing the foot-receiving member 17 and installing an alternate member within the tracks in the base plate. Because the binding can be quickly changed, retail stores can offer a basic ski with a variety of interchangable bindings in various sizes and styles at low cost and with a minimum of effort or inconvenience.

While the invention has been shown in only one of its forms, it is not thus limited but is susceptible to various changes and modifications without departing to the spirit thereof.

I claim:

1. A water ski binding for a conventional water ski of the type having a planar upper surface for receiving a user's foot, comprising:

a base plate adapted to be mounted on a water ski, the base plate having an upper surface and a bottom, generally planar surface adapted to be mounted flush with the planar upper surface of the water ski, the upper surface of the base plate being provided with a pair of tracks arranged in spaced-apart locations, the tracks penetrating the upper surface of the base plate to a preselected depth, thereby defining a cross-sectional profile in the upper surface of the base plate;

a foot-receiving member formed from a resilient material and having depending runners, the runners having a complimentary cross-sectional profile which mates with that of the tracks when the runners are received within the tracks to secure the foot-receiving member on the water ski.

2. A water ski binding for a conventional water ski of the type having a planar upper surface for receiving a user's foot, comprising:

a base plate adapted to be mounted on a water ski, the base plate having a top, generally planar surface and a bottom, generally planar surface adapted to be mounted flush with the planar upper surface of the water ski, the top surface of the base plate being provided with a pair of tracks arranged in spaced-apart, parallel locations, the tracks penetrating the top, generally planar surface of the base plate to a preselected vertical depth, thereby defining a cross-sectional profile in the top surface of the base plate;

a foot-receiving member formed from a resilient material and having depending runners, the runners having a complimentary cross-sectional profile which mates with that of the tracks when the runners are received within the tracks, to secure the foot-receiving member on the water ski.

3. A water ski binding for a conventional water ski of the type having a planar upper surface for receiving a user's foot, comprising:

a base plate adapted to be mounted on a water ski, the base plate having a top, generally planar surface separated from a bottom, generally planar surface, which is adapted to be mounted flush with the planar upper surface of the water ski, by a thickness to thereby define a toe, a back, and opposing sides of the base plate, the top surface of the base plate being provided with a pair of tracks arranged in spaced-apart locations which run parallel to the opposing sides, the tracks penetrating the top, generally planar surface of the base plate to a preselected vertical depth, thereby defining a cross-sectional profile in the top surface of the base plate;

an arch-shaped, foot-receiving member formed from a resilient material and having depending runners, the runners having a complimentary cross-sectional profile which mates with that of the tracks when the runners are received within the tracks, so that the depending runners extend downwardly through the top, generally planar surface of the base plate for the track depth to secure the foot-receiving member on the water ski.

4. The water ski binding of claim 3, wherein the tracks in the base plate and the runners of the foot-receiving member interlock in tongue and groove fashion.

5. The water ski binding of claim 3, wherein the foot-receiving member is formed as an elastomeric, arch-shaped portion having opposing sides which terminate in side edges, each of the opposing side edges having an initially separate, rigid runner attached thereto.

6. The water ski binding of claim 3, wherein the foot-receiving member is formed in one piece as an integral elastomeric member.

7. The water ski binding of claim 3, wherein each of the tracks in the top surface of the base plate has an open end and a closed end, and wherein a plug is received in each of the base plate tracks after the foot-receiving member is installed to lock the runners of the foot-receiving member within the base plate tracks.

8. The water ski binding of claim 3, wherein each of the tracks in the upper surface of the base plate defines a dove-tail profile for engaging a mating profile of the foot-receiving member.

9. An improved water ski having a planar upper surface for receiving a user's foot, comprising:

a base plate mounted flush on the planar upper surface of the water ski, the base plate having a top, generally planar surface and a bottom, generally planar surface adapted to be mounted flush with the planar upper surface of the water ski, the top surface of the base plate being provided with a pair of tracks arranged in spaced-apart, parallel locations, the tracks penetrating the top, generally planar surface of the base plate to a preselected vertical depth, thereby defining a cross-sectional profile in the top surface of the base plate;

a foot-receiving member formed from a resilient material and having depending runners, the runners being received within the tracks on the top surface of the base plate, the runners having a complimentary cross-sectional profile which mates with that of the tracks when the runners are received within the tracks, so that the depending runners extend downwardly through the top, generally planar surface of the base plate for the track depth, the mating engagement of the depending runners and tracks forming the sole means for securing the foot-receiving member on the water ski.

10. A method of mounting a water ski binding on the upper surface of a conventional water ski of the type having a planar upper surface for receiving a user's foot, comprising the steps of: mounting a base plate on the water ski, the base plate having a top, generally planar surface and a bottom, generally planar surface adapted to be mounted flush with the planar upper surface of the water ski, the top surface of the base plate being provided with a pair of tracks arranged in spaced-apart, parallel locations, the tracks penetrating the top, generally planar surface of the base plate to a preselected vertical depth, thereby defining a cross-sectional profile in the top surface of the base plate each of the tracks having at least one open end;

providing a foot-receiving member formed from a resilient material and having depending runners for engaging the top surface of the base plate;

engaging the foot-receiving member on the base plate by sliding the runners into an open end of the tracks provided in the top surface of the base plate and moving the runners in a direction parallel to this top surface of the base plate, the runners being provided with a complimentary cross-sectional profile which mates with that of the tracks and provides the sole means for securing, the foot-receiving member against vertical relative movement of the runners from within the tracks provided on the water ski.

11. The method of claim 10, further comprising the step of:

locking the foot-receiving member to the base plate by sliding a plug into at least one of the tracks behind the runner which is received within the track.

12. The method of claim 10, wherein the foot-receiving member is formed as an elastomeric, arch-shaped portion having opposing sides which terminate in side edges, each of the opposing side edges having an initially separate, rigid runner attached thereto.

13. The method of claim 10, wherein the foot-receiving member is formed in one piece as an integral elastomeric member.

* * * * *